US008893631B2

(12) United States Patent
Fujihara

(10) Patent No.: US 8,893,631 B2
(45) Date of Patent: Nov. 25, 2014

(54) MULTI-NEEDLE SEWING MACHINE

(75) Inventor: Shinya Fujihara, Obu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 258 days.

(21) Appl. No.: 13/543,387

(22) Filed: Jul. 6, 2012

(65) Prior Publication Data

US 2013/0025517 A1 Jan. 31, 2013

(30) Foreign Application Priority Data

Jul. 27, 2011 (JP) ..... 2011-164474

(51) Int. Cl.
*D05B 1/08* (2006.01)
*D05C 11/20* (2006.01)
*D05B 65/06* (2006.01)

(52) U.S. Cl.
CPC ..... *D05C 11/20* (2013.01); *D05B 65/06* (2013.01)
USPC ..... 112/163

(58) Field of Classification Search
USPC ..... 112/163, 285, 291, 292, 293, 253, 302
See application file for complete search history.

(56) References Cited

U.S. PATENT DOCUMENTS

| | | | | |
|---|---|---|---|---|
| 4,803,941 | A * | 2/1989 | Schreiber et al. | 112/83 |
| 5,138,961 | A * | 8/1992 | Nakano et al. | 112/291 |
| RE44,885 | E * | 5/2014 | James et al. | 112/475.08 |
| 2007/0186831 | A1 | 8/2007 | Shimizu | |

FOREIGN PATENT DOCUMENTS

| | | |
|---|---|---|
| JP | Y2-60-23345 | 7/1985 |
| JP | Y2-61-42950 | 12/1986 |
| JP | A-2000-024361 | 1/2000 |
| JP | A-2007-215734 | 8/2007 |

* cited by examiner

*Primary Examiner* — Tejash Patel
(74) *Attorney, Agent, or Firm* — Oliff PLC

(57) ABSTRACT

A multi-needle sewing machine includes needle bars, presser feet, a support member configured to support the needle bars such that the needle bars can move up and down, a cutting member, a guide member configured to move between an extended position and a stand-by position, and a holding member configured to hold an end portion of a upper thread, the holding member including a fixed member that is mounted to the support member, movable members each of which is provided for one of the needle bars, and includes a guide portion formed by cutting a notch in an outer end portion on the needle bar side of the movable member, and elastic members each of which is provided for one of the movable members and configured to elastically energize the one of the movable members toward the fixed member.

8 Claims, 19 Drawing Sheets

MULTI-NEEDLE SEWING MACHINE

CROSS-REFERENCE TO RELATED APPLICATION

This application claims priority to Japanese Patent Application No. 2011-164474, filed Jul. 27, 2011, the content of which is hereby incorporated herein by reference in its entirety.

BACKGROUND

The present disclosure relates to a multi-needle sewing machine that has a plurality of needle bars.

A multi-needle sewing machine that has a plurality of needle bars has been known for some time. The multi-needle sewing machine can automatically sew an embroidery pattern that is made up of a plurality of colors. The multi-needle sewing machine is provided with a needle bar case that supports the plurality of needle bars, each of which is provided with a sewing needle at its lower end, such that they can move up and down, and with a needle bar case moving mechanism that moves the needle bar case. An upper thread of a different color is passed through the eye of each of the sewing needles. An operation of the needle bar case moving mechanism based on specified embroidery data positions one of the plurality of the needle bars moves to a point directly above a needle drop point, which is a sewing position. Stitches of a first color are formed on a work cloth by moving the needle bar that is positioned directly above the needle drop point up and down. After that, the upper thread that has been used for forming the stitches of the first color is cut by a thread-cutting mechanism. Next, the needle bar case moves, a different needle bar moves to a point directly above the needle drop point, and stitches of a second color are formed. Stitches of third and subsequent colors are formed in the same manner. The embroidery pattern that is made up of a plurality of colors is thus automatically sewn by the sequential changing of the needle bar that is in the sewing position, based on the specified embroidery data.

After the thread-cutting mechanism has cut the upper thread, an end portion of the cut upper thread may be in a state in which it is hanging down from the eye of the sewing needle. If the next sewing operation is performed with the upper thread in this state, the end portion of the cut upper thread may be entangled in the next sewing operation. Accordingly, a multi-needle sewing machine is known that holds the end portion of the cut upper thread in order to prevent the cut upper thread from being entangled in the next sewing operation. The multi-needle sewing machine is provided with an upper thread pull-up member to pull up the end portion of the cut upper thread. The pulled-up end portion of the upper thread is pulled between a presser plate and a tape. The presser plate is energized by a spring toward the tape, which is provided with a group of projections. The end portion of the upper thread may be pressed between the presser plate and the tape. The tape is provided with the group of projections in order to prevent the end portion of the upper thread from shifting horizontally even in a case where the needle bar case moves in the direction in which the needle bars are arrayed.

SUMMARY

However, in the known multi-needle sewing machine that is described above, the holding of the end portion of the upper thread by the group of projections may be unstable. Therefore, in a case where the needle bar case moves in the direction in which the plurality of needle bars are arrayed, there may be cases in which the multi-needle sewing machine cannot prevent the end portion of the upper thread from shifting horizontally.

Various embodiments of the broad principles derived herein provide a multi-needle sewing machine that is able to hold an end portion of a cut upper thread and to prevent the end portion of the upper thread from shifting horizontally, even in a case where the needle bar case moves in the direction in which the plurality of needle bars are arrayed.

Embodiments provide a multi-needle sewing machine that includes needle bars, presser feet, a support member, a cutting member, a guide member, and a holding member. The needle bars that are arranged and on the lower end of each of which a sewing needle can be mounted. The presser feet, each of which is provided below one of the needle bars and configured to move up and down between a lower position and an upper position. The lower position is a position that the presser foot can contact a work cloth. The upper position is a position that is higher than the lower position. The support member configured to support the needle bars such that the needle bars can move up and down, and configured to move one of the needle bars to a position directly above a needle drop point by moving along an array direction in which the needle bars are arrayed. The needle drop point is a sewing position on the work cloth. The cutting member that is provided below the needle drop point and configured to cut an upper thread inserted through and extending downward from an eye of the sewing needle that is mounted to one of the needle bars positioned directly above the needle drop point. The guide member configured to move between an extended position and a stand-by position, configured to catch the upper thread at the extended position, and configured to guide the upper thread by moving from the extended position to the stand-by position. The extended position is a position to which the guide member is extended and that is located between the needle drop point and one of the presser feet provided below the one of the needle bars positioned directly above the needle drop point, the one of the presser feet being in the upper position. The stand-by position is a position in which the guide member is separated from a gap between the needle drop point and the one of the presser feet that is in the upper position. The holding member configured to hold an end portion of the upper thread that has been guided by the guide member and has been cut by the cutting member. The holding member includes a fixed member, movable members, and elastic members. The fixed member that is mounted to the support member. The movable members each of which is provided for one of the needle bars, configured to move in relation to the fixed member and to rotate between an open position and a clamping position, and includes a guide portion formed by cutting a notch in an outer end portion on the needle bar side of the movable member. The open position is a position in which the movable member is separated from the fixed member, such that the guide member can move to the extended position. The clamping position is a position in which the movable member is positioned on a travel path of the guide member and is in contact with the fixed member. The travel path is a path between the extended position and the stand-by position of the guide member. The elastic members each of which is provided for one of the movable members and configured to elastically energize the one of the movable members toward the fixed member, such that the one of the movable members to be positioned in the clamping position. The guide member, when the guide member moves from the stand-by position to the extended position, moves one of the movable members from the clamping position to the open position in opposition to an elastic force of corresponding one of the elastic members. The guide member, when the guide member moves from the extended position to the stand-by position, guides the upper thread to the guide portion of the corresponding one of the movable members, and the end portion of the upper thread is clamped between the fixed member and the one of the movable members, which has been moved to the clamping position by the elastic force of the corresponding one of the elastic members.

BRIEF DESCRIPTION OF THE DRAWINGS

Exemplary embodiments will be described below in detail with reference to the accompanying drawings in which.

DETAILED DESCRIPTION

Hereinafter, a multi-needle sewing machine 1 of the present disclosure will be explained with reference to the drawings. The physical configuration of the multi-needle sewing machine 1 will be explained with reference to FIGS. 1 to 13. In the explanation that follows, the lower left, the upper right, the lower right, the upper left, the upward, and the downward directions respectively correspond to the front side, the rear side, the right side, the left side, the upper side, and the lower side of the multi-needle sewing machine 1.

Figure 1:
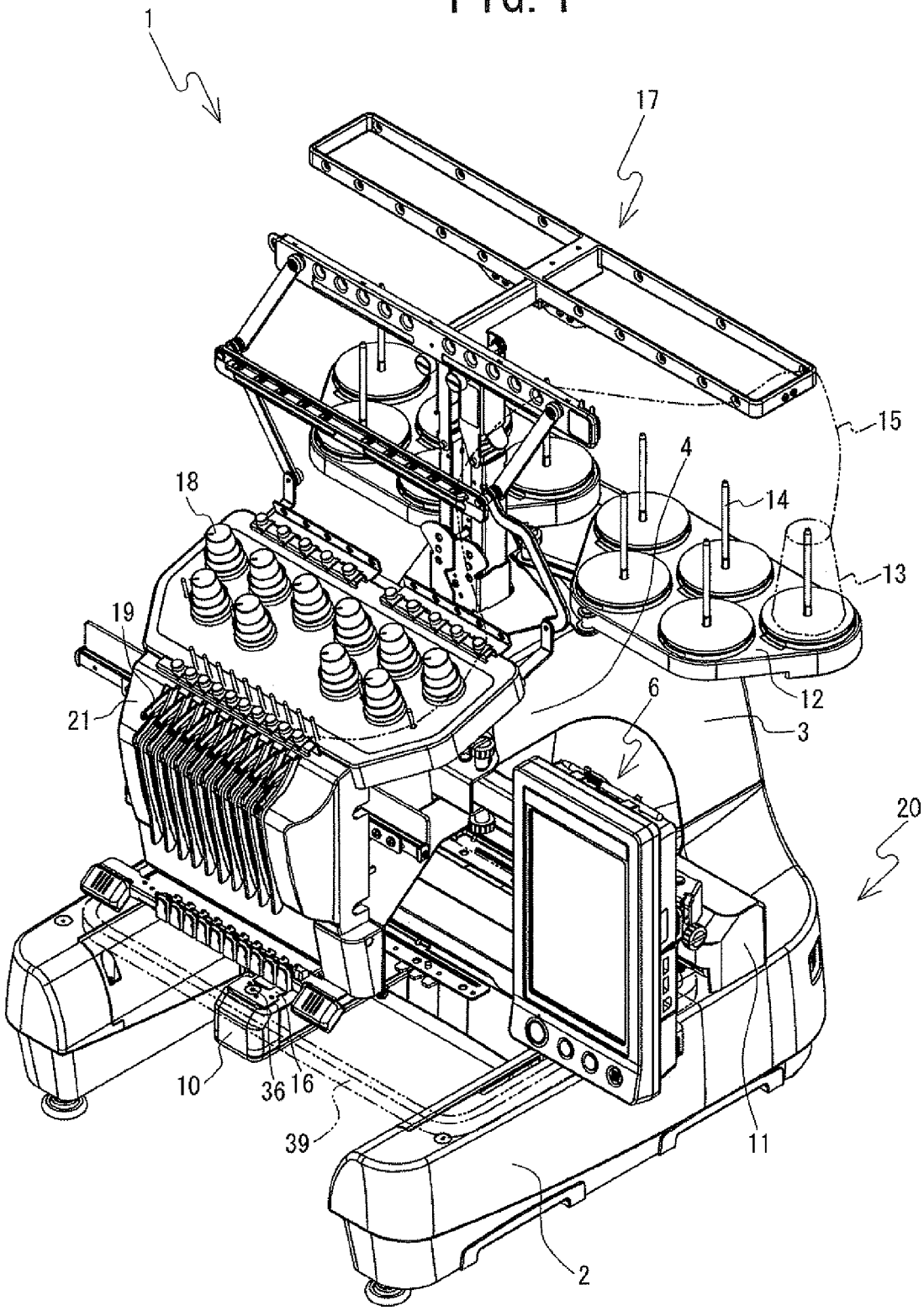
FIG. 1 is a perspective view of a multi-needle sewing machine.

As shown in FIG. 1, a sewing machine body 20 of the multi-needle sewing machine 1 includes a support portion 2, a pillar 3, and an arm 4. The support portion 2 is formed in an inverted U shape in a plan view, and it supports the entire multi-needle sewing machine 1. The pillar 3 extends upward from the rear portion of the support portion 2. The arm 4 extends toward the front from the upper end of the pillar 3.

A needle bar case 21 is provided on the front end of the arm 4. The needle bar case 21 may support ten needle bars 31. A sewing needle can be mounted on the lower end of each of the needle bars 31. The needle bar case 21 will be described in detail later. An operation portion 6 is provided on the right side of the arm 4, midway between the front and the rear. The operation portion 6 may be rotatably supported by the arm 4, with its axis of rotation being an axis that extends in the up-down direction (not shown in the drawings). The operation portion 6 can be used to accept commands from a user.

An embroidery frame 39 and an embroidery frame transport mechanism 11 are provided below the arm 4. The embroidery frame 39 may be removably disposed in the multi-needle sewing machine 1. The embroidery frame transport mechanism 11 capable of moving the embroidery frame 39 toward the front, the rear, the left, and the right. In FIG. 1, the position in which the embroidery frame 39 is disposed is indicated by a broken line. A work cloth 40 (refer to FIG. 4) that is an object of sewing may be mounted on the inner side of the embroidery frame 39. The embroidery frame 39 may be set on a carriage (not shown in the drawings) of the embroidery frame transport mechanism 11. The multi-needle sewing machine 1 may perform sewing of an embroidery pattern or the like while moving the embroidery frame 39 toward the front, the rear, the left, and the right by controlling an X axis motor (not shown in the drawings) and a Y axis motor (not shown in the drawings) of the embroidery frame transport mechanism 11.

A cylindrical cylinder head 10 is provided below the arm 4 and on the bottom side of the work cloth 40 that is mounted in the embroidery frame 39. The cylinder head 10 extends toward the front from the bottom end of the pillar 3. A needle plate 16 that is rectangular in a plan view is provided on the top surface of the front end of the cylinder head 10. A needle hole 36 into which a sewing needle 35 (refer to FIG. 2) may be inserted is provided in the needle plate 16.

Figure 4:
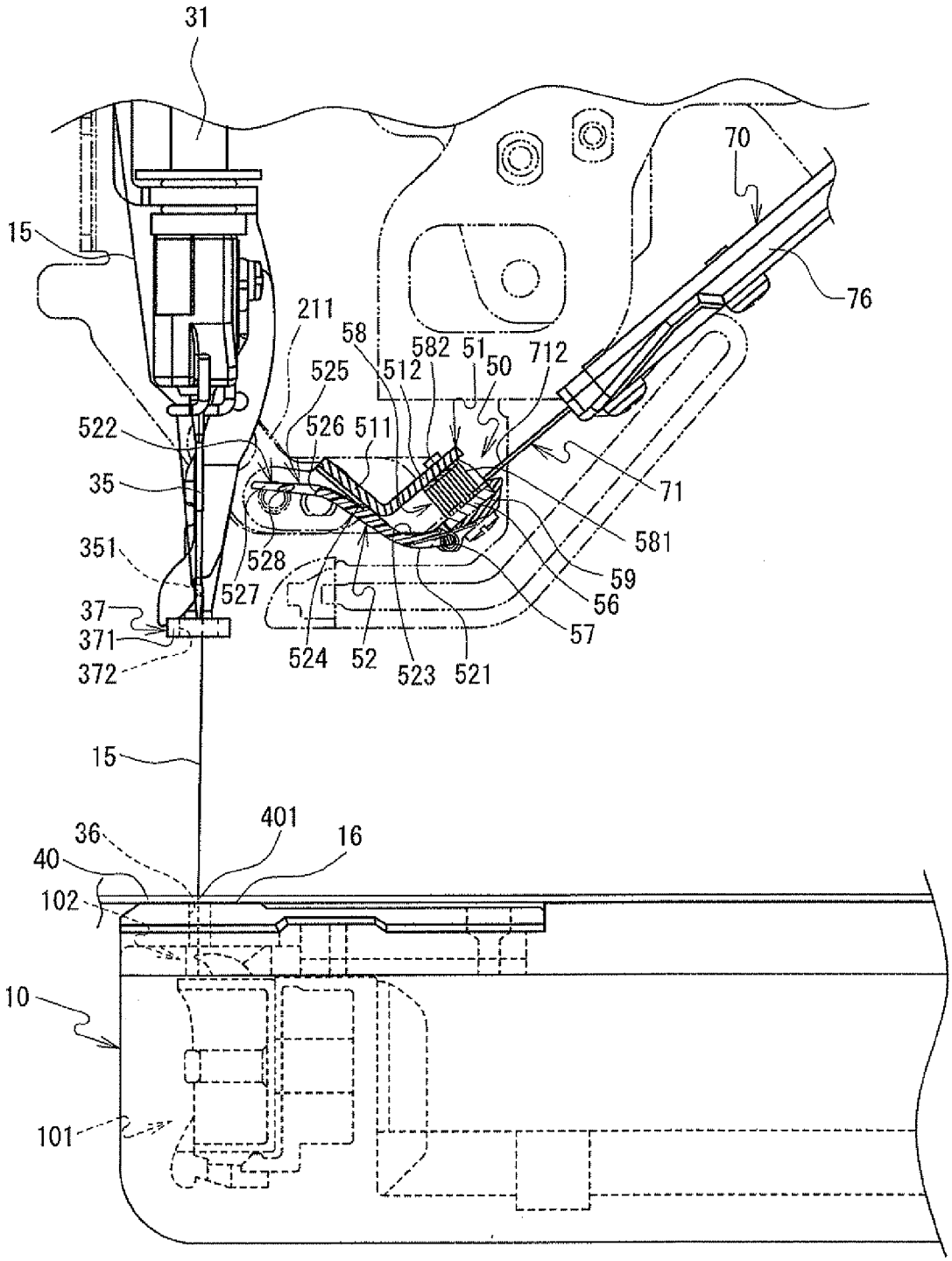
FIG. 4 is a figure that shows a state in which, before an upper thread is clamped, a wiper is in a stand-by position, and a movable plate is in a clamping position.
Figure 13:
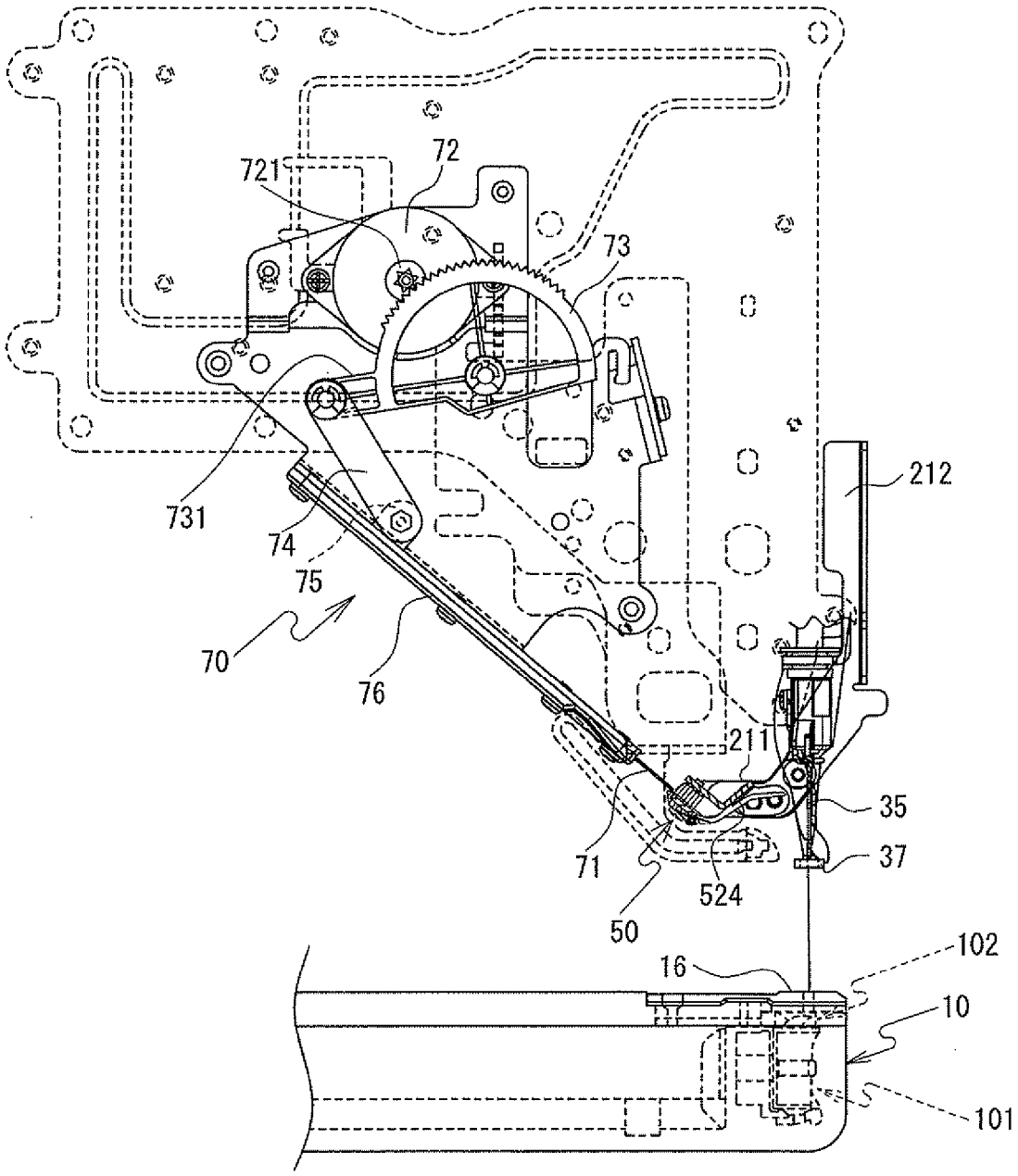
FIG. 13 is a left side view of the wiper mechanism.

As shown in FIGS. 4 and 13, a shuttle 101 and a thread-cutting mechanism 102 are provided in the interior of the front end of the cylinder head 10. The shuttle 101 may contain a bobbin (not shown in the drawings) around which a lower thread (not shown in the drawings) is wound. A shuttle drive mechanism (not shown in the drawings) is provided in the interior of the cylinder head 10. The shuttle drive mechanism drives the shuttle 101 rotationally. The thread-cutting mechanism 102 is provided on the top side of the shuttle 101. The thread-cutting mechanism 102 is positioned below the needle drop point, and is configured to cut an upper thread 15 that inserted through and extending downward from an eye 351 of the sewing needle 35. For example, Japanese Laid-Open Patent Publication No. 2007-215734 discloses the thread-cutting mechanism, the relevant portions of which are incorporated herein by reference. The thread-cutting mechanism 102 includes a moving blade and a fixed blade, and having used the moving blade to catch the upper thread 15 and the lower thread, it cuts the upper thread 15 and the lower thread between the fixed blade and the moving blade.

As shown in FIG. 1, a left-right pair of thread spool holders 12 are provided on the rear face side of the top face of the arm 4. Five thread spool pins 14 are provided on each of the thread spool holders 12. The thread spool pins 14 are pins that extend in the up-down direction. The thread spool pins 14 support thread spools 13. Ten thread spools 13, the same number as the number of the needle bars 31, can be installed on the pair of the thread spool holders 12. The upper threads 15 may be supplied from the thread spools 13 that are installed on the thread spool holders 12. The upper threads 15 may be supplied through thread guide paths to the eyes 351 of the corresponding sewing needles 35 that are mounted on the lower ends of the needle bars 31 (refer to FIG. 4). The thread guide paths include thread guides 17, tensioners 18, thread take-up levers 19, and needle bar thread hooks (not shown in the drawings).

Figure 2:
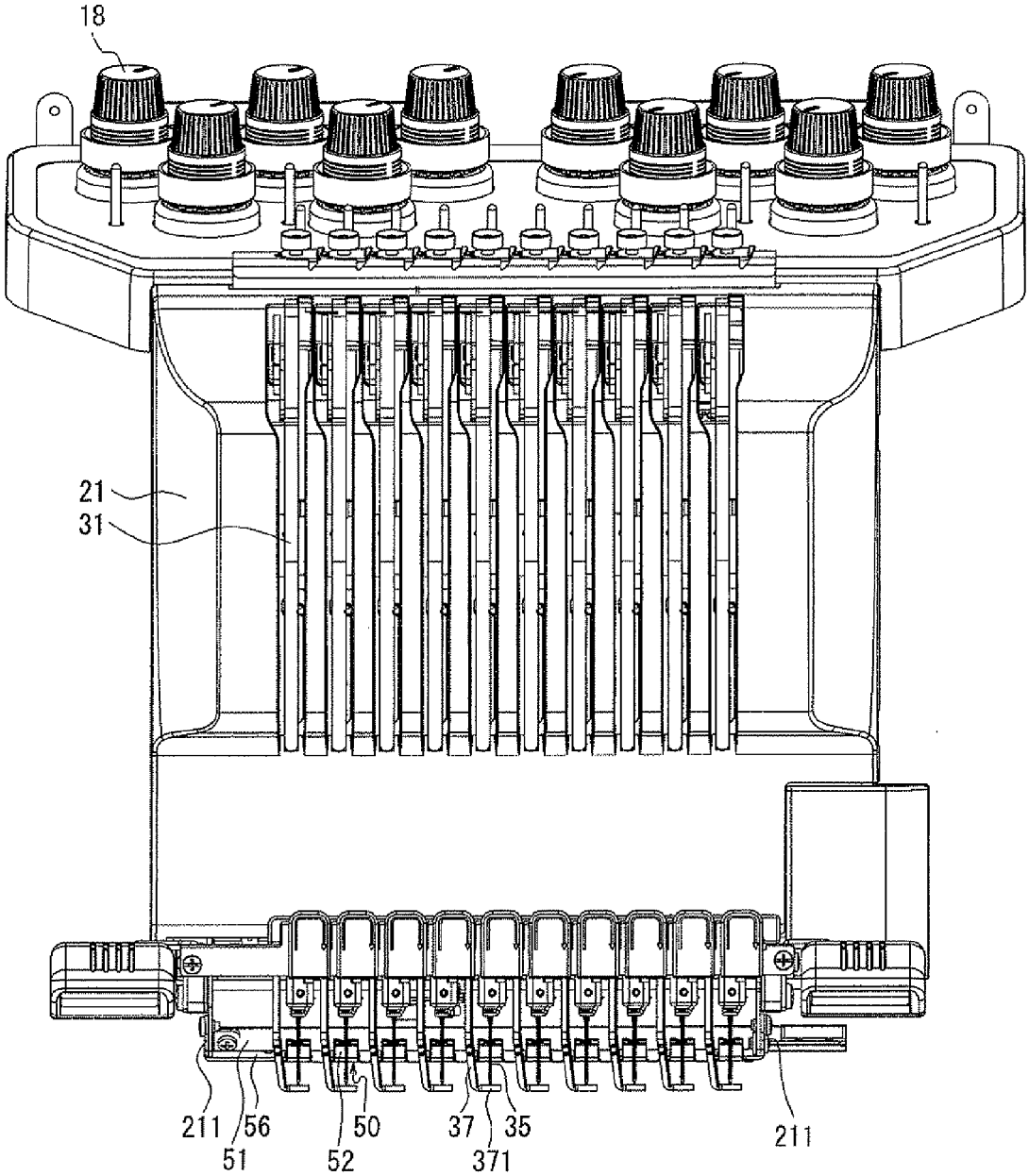
FIG. 2 is a front view of a needle bar case.

The needle bar case 21 will be explained. As shown in FIG. 2, the needle bar case 21 is configured to support the ten needle bars 31 such that the needle bars 31 can move up and down. The ten needle bars 31 are arrayed in the left-right direction. The needle bar case 21 can move in left-right direction by being driven by a drive motor (not shown in the drawings). That is, the needle bar case 21 can move in the direction in which the needle bars 31 are arrayed. Each of the ten needle bars 31 extends in the up-down direction. The sewing needles 35 may be mounted to the lower ends of the needle bars 31, respectively. The needle bar case 21 is provided with presser feet 37. Each of the presser feet 37 is disposed below one of the needle bars 31. A thread holes 372 (refer to FIG. 4), which extends in the up-down direction through which the sewing needle 35 and the upper thread 15 can pass in the up-down direction, is formed in each of lower end portions 371 of the presser feet 37. Each of the presser feet 37 is configured to move in the up-down direction between a lower position and an upper position. The lower position is a position in which each of the presser feet 37 may contact the work cloth 40. The upper position is a position that is higher than the lower position, and in which each of the presser feet 37 may be separated from the work cloth 40. When the presser foot 37 is in the lower position, the lower end portion 371 of the presser foot 37 may contact the work cloth 40. The presser foot 37 may move together with the up-down movement of the needle bar 31 and intermittently presses down on the work cloth 40 (refer to FIG. 4).

In a case where sewing is performed on the work cloth 40, the needle bar case 21 is configured to move one of the plurality of needle bars 31 to a position directly above a needle drop point 401 (refer to FIG. 4) by moving in the left-right direction. The needle drop point 401 is a sewing position on the work cloth 40. Then the needle bar 31 that has been moved to the position directly above the needle drop point 401 may be slid up and down by a needle bar drive mechanism (not shown in the drawings) that may be provided in the interior of the needle bar case 21, and sewing may be performed on the work cloth 40.

The multi-needle sewing machine 1 includes a holding member 50 and a wiper 71 (refer to FIGS. 4 and 13). The holding member 50 is a member that is configured to hold end portions of the upper threads 15. The wiper 71 is a member that may guide the upper thread 15 to the holding member 50 (refer to FIG. 18). The wiper 71 is configured to move between a stand-by position (refer to FIGS. 4 and 18) and an extended position (refer to FIG. 16). The extended position is a position in which the wiper 71 is extended toward the gap between the needle drop point 401 and the presser foot 37 that is in the upper position. The wiper 71 may catch the upper thread 15 by moving to the extended position (refer to FIG. 16). After catching the upper thread 15, the wiper 71 may guide the upper thread 15 to the holding member 50 by moving to the stand-by position. The stand-by position is a position in which the wiper 71 is separated from the gap between the needle drop point 401 and the presser foot 37 that is in the upper position.

Figure 3:
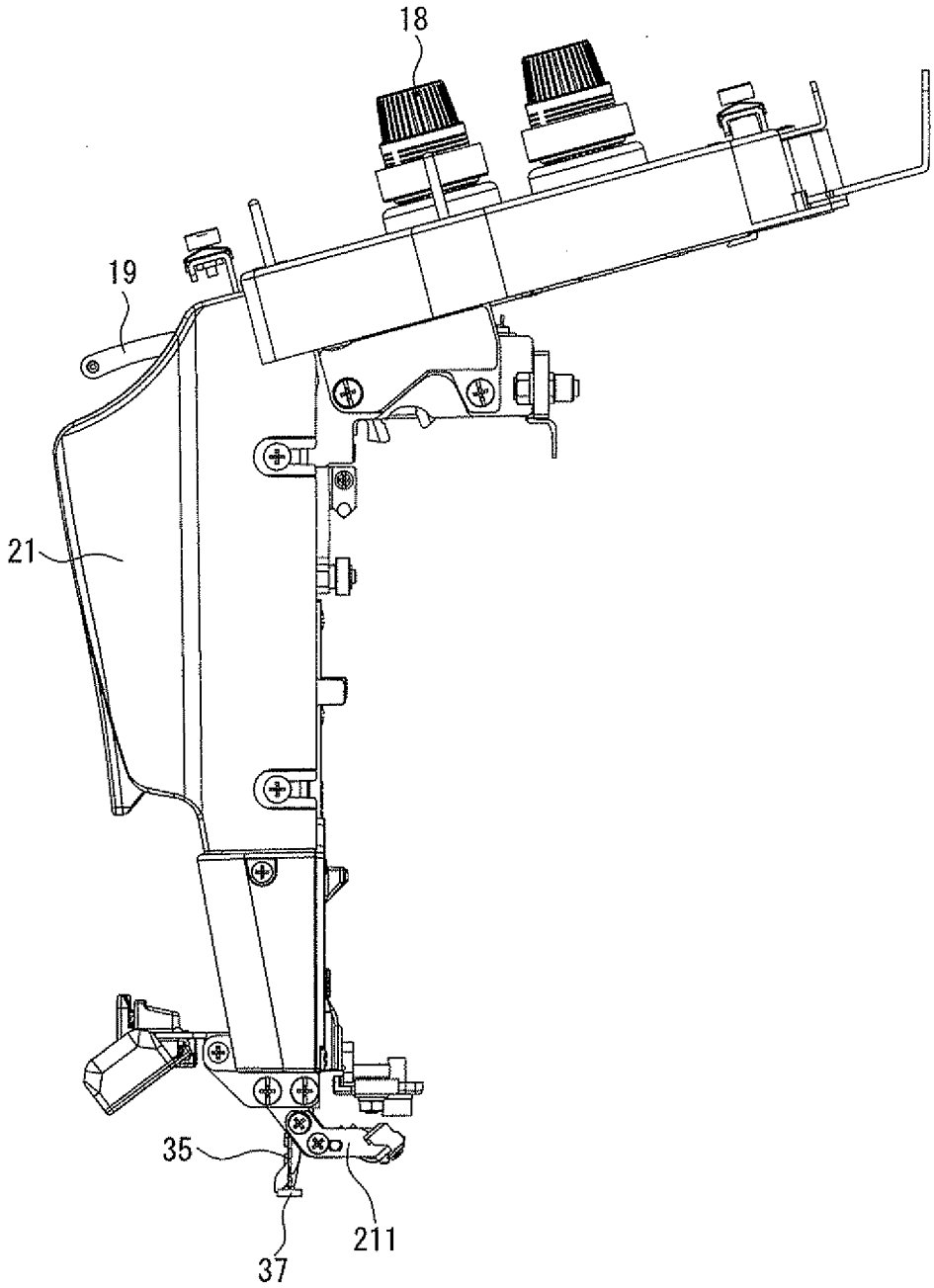
FIG. 3 is a right side view of the needle bar case.

The holding member 50 will be explained with reference to FIGS. 2 to 12. In FIG. 4, a fixed plate 51, a movable plate 52, a movable plate support member 56, and a fiber member 58 are shown in cross section. As shown in FIGS. 2 and 3, plate-shaped base members 211 are provided on both ends of the needle bar case 21 in the left-right direction, each extending toward the rear from a lower edge portion of the needle bar case 21. Each of the base members 211 includes an attachment portion 212 (refer to FIG. 6) that extends upward from a front end. The base members 211 are mounted to the lower edge of the needle bar case 21 by mounting the attachment portions 212 to the needle bar case 21. As shown in FIG. 2, the holding member 50 is supported by the left and right base members 211. The holding member 50 is also positioned to the rear of each of the ten sewing needles 35.

As shown in FIG. 4, the holding member 50 includes the fixed plate 51, the movable plates 52, a movable plate holder 59, the movable plate support member 56, coil springs 57, and the fiber member 58. The fixed plate 51 is a plate member that extends in the left-right direction and is coupled to the left and right base members 211 (refer to FIGS. 2, 5, and 6). The fixed plate 51 includes a first plate portion 511 and a second plate portion 512 formed as a single unit. The first plate portion 511 extends obliquely downward toward the rear. The second plate portion 512 extends obliquely upward toward the rear from the lower rear edge portion of the first plate portion 511.

The movable plate support member 56 is positioned opposite a bottom face of the second plate portion 512. The movable plate support member 56 may be a metal member that supports the movable plates 52 such that the movable plates 52 can rotate. The movable plate support member 56 is provided between the base members 211 (refer to FIGS. 2, 5, and 6). The movable plates 52 are curved plate-shaped members that may be formed from a resin material and extend in the front-rear direction. The movable plates 52 are ten in number, and each is positioned to the rear of one of the ten sewing needles 35. Each of the movable plates 52 is thus provided for one of the needle bars 31, in a position opposite the fixed plate 51.

Figure 7:
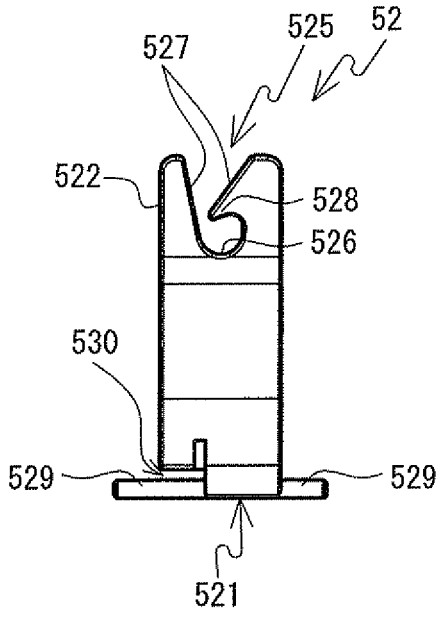
FIG. 7 is a figure that shows the movable plate as seen from below.
Figure 8:
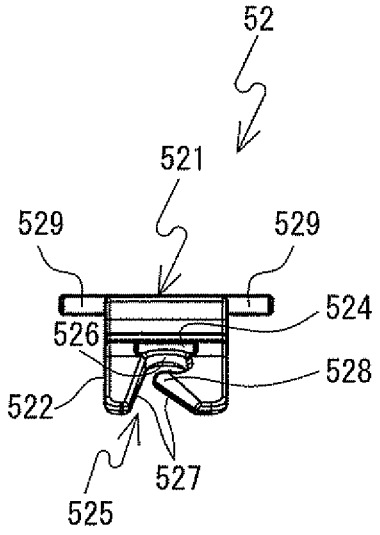
FIG. 8 is a figure that shows the movable plate of FIG. 7, as seen from the top.
Figure 9:
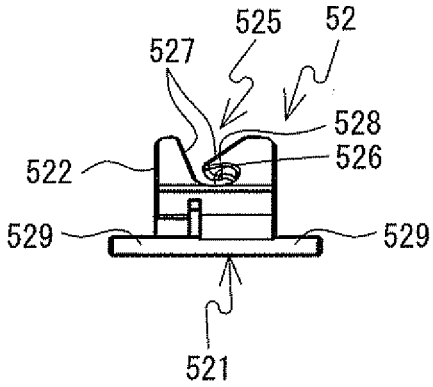
FIG. 9 is a figure that shows the movable plate of FIG. 7, as seen from the bottom.

One of the movable plates 52 is shown in FIGS. 7 to 11. FIG. 7 is a drawing of the movable plate 52 as seen from below. FIG. 8, FIG. 9, FIG. 10, and FIG. 11 are drawings of the movable plate 52 that is shown in FIG. 7 as seen from the top, the bottom, the left side, and the right side of the page, respectively. As shown in FIG. 7, two shaft portions 529 are provided as a single unit on a rear edge (a base end portion 521) of the movable plate 52 such that the shaft portions 529 protrude outward to the left and the right. The length of each of the shaft portions 529 is a length that projects slightly to the outside of the external form of the movable plate 52 in the left-right direction. A slot 530 is formed at the base end of the shaft portion 529 on the left side. The forming of the slot 530 makes it possible to mount the coil spring 57 (refer to FIG. 12) on the shaft portion 529. As shown in FIG. 12, each of the shaft portions 529 is supported by the movable plate holder 59, which is formed from a resin material, such that the shaft portions 529 can rotate. The movable plate holder 59 is mounted to the movable plate support member 56 by screws 591. In this manner, the movable plate 52 is supported by the movable plate support member 56 such that the movable plate 52 can rotate. The coil spring 57 is mounted at the base end of the shaft portion 529 on the left side. The coil springs 57 each of which is provided for one of the movable plate 52 and configured to elastically energize the movable plate 52 toward the fixed plate 51, with the shaft portions 529 serving as the axis of rotation.

The movable plate 52 is configured to move in relation to the fixed plate 51 and to rotate between a clamping position and an open position. The clamping position is a position in which the end portion of the corresponding upper thread 15 is clamped between the fixed plate 51 (the first plate portion 511) and the movable plate 52 (refer to FIGS. 4 and 18). The elastic force of the coil spring 57 energizes the movable plate 52 in the direction in which it rotates toward the fixed plate 51, so as to position the movable plate 52 in the clamping position. Therefore, the movable plate 52 may be positioned in the clamping position. The open position is a position in which the movable plate 52 is separated from the fixed plate 51 (refer to FIG. 16). When the movable plate 52 is in the clamping position, the movable plate 52 is positioned on a travel path of the wiper 71. The travel path is the path that the wiper 71 follows when the wiper 71 moves between the extended position and the stand-by position. When the wiper 71 moves from the stand-by position to the extended position, the wiper 71 is able to push the movable plate 52 in a direction that is opposite to the direction of the energizing force of the coil spring 57. The pushing of the movable plate 52 by the wiper 71 may move the movable plate 52 from the clamping position to the open position. When the movable plate 52 is in the open position, the wiper 71 is able to pass between the movable plate 52 and the fixed plate 51. When the wiper 71 moves away from the movable plate 52, the movable plate 52 may be moved from the open position to the clamping position by the elastic force of the coil spring 57. FIG. 4 shows a state before the upper thread 15 is cut, so the end portion of the upper thread 15 is not clamped between the fixed plate 51 and the movable plate 52. However, when the movable plate 52 is positioned on the travel path of the wiper 71 and is in contact with the fixed plate 51, it is deemed to be in the clamping position.

An outer end portion 522 is an end portion on the sewing needle 35 side of the movable plate 52. As shown in FIG. 4, the outer end portion 522 of the movable plate 52 is curved in a direction (to the left on the page) away from the wiper 71 in the extended position. Therefore, when the movable plate 52 is in the open position and the wiper 71 is in the extended position, the outer end portion 522 of the movable plate 52 may not be in contact with the wiper 71 (refer to FIG. 16).

The base end portion 521 of the movable plate 52 is curved such that its rear edge turns slightly upward (to the right on the page). The top face of the curved portion is a contact face 523 with which the wiper 71 may come into contact. The contact face 523 is configured to contact a tip of the wiper 71 when the wiper 71 moves from the stand-by position to the extended position. In a case where the movable plate 52 is in the clamped position, the contact face 523 is inclined in relation to the travel path (the movement direction) of the wiper 71. Specifically, in a case where the tip of the wiper 71 is in contact with the contact face 523, the contact face 523 is inclined in relation to the travel path of the wiper 71 such that, of the angles that are formed by the travel path of the wiper 71 and the contact face 523, an angle θ on the outer end portion 522 side of the movable plate 52 is an obtuse angle (refer to FIG. 14).

Figure 10:
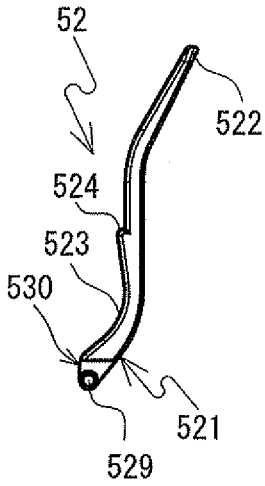
FIG. 10 is a figure that shows the movable plate of FIG. 7, as seen from the left side.
Figure 11:
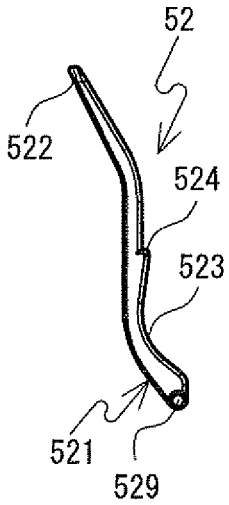
FIG. 11 is a figure that shows the movable plate of FIG. 7, as seen from the right side.
Figure 12:
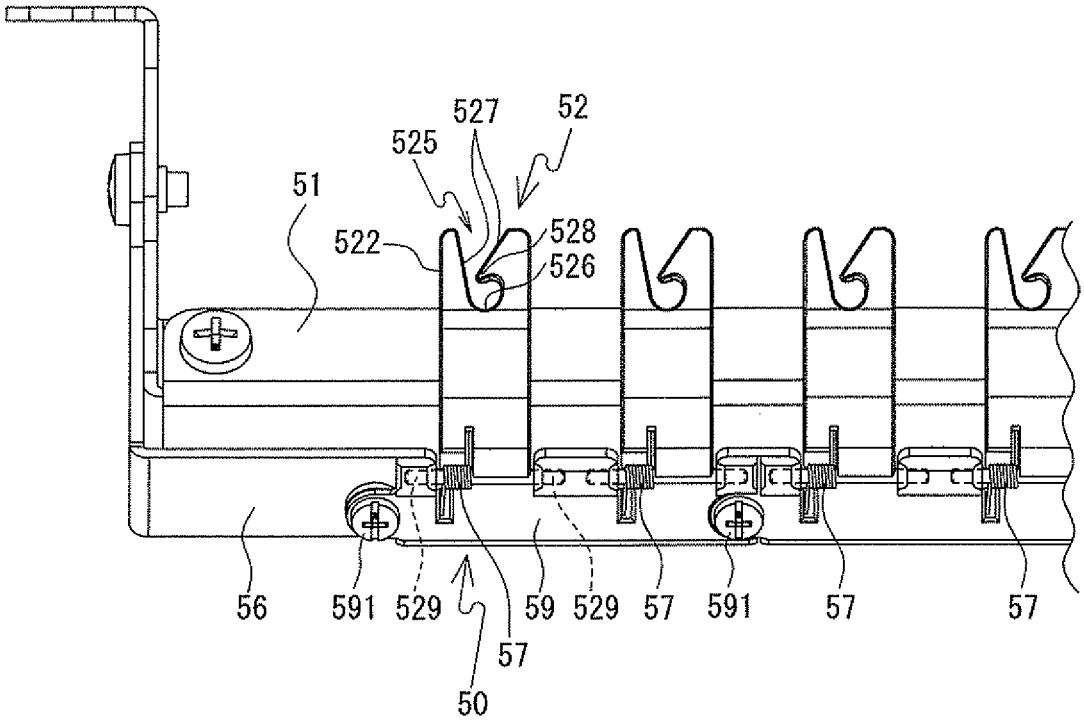
FIG. 12 is a bottom view of the holding member.

A raised portion 524 that protrudes upward toward the fixed plate 51 is provided between the outer end portion 522 and the base end portion 521 of the movable plate 52 (refer to FIGS. 10 and 11). The raised portion 524 is configured to contact with the fixed plate 51 when the movable plate 52 is in the clamping position. Therefore, when the movable plate 52 is in the clamping position, the raised portion 524 may clamp the end portion of the upper thread 15 against the fixed plate 51 (the first plate portion 511) (refer to FIG. 18).

Figure 5:
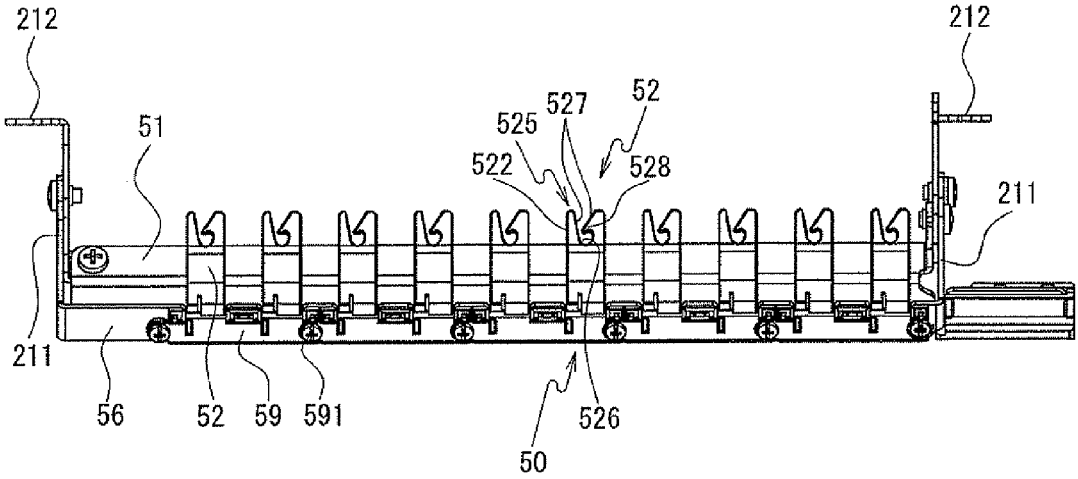
FIG. 5 is a bottom view of a holding member.

As shown in FIGS. 5, 7, and 12, a guide portion 525 is provided in the outer end portion 522 of the movable plate 52. The guide portion 525 is formed by cutting a notch out of the outer end portion 522. The end portion of the upper thread 15 can pass through the guide portion 525. The guide portion 525 is a portion that may guide the end portion of the upper thread 15 while restricting the movement of the end portion of the upper thread 15 in the left-right direction. The guide portion 525 includes a partial hole 526, an opening portion 527, and a hook portion 528. The partial hole 526 is a through-hole that is provided slightly to the rear of the outer end of the movable plate 52. When the holding member 50 clamps the end portion of the upper thread 15, the partial hole 526 may guide the end portion of the upper thread 15 into the partial hole 526 while restricting the movement of the end portion of the upper thread 15 in the left-right direction. The opening portion 527 is a portion that is formed as an opening in the outer end of the movable plate 52, and width of the opening portion 527 becomes wider toward the outer end. The partial hole 526 is continuous with the opening portion 527. The hook portion 528 is a hook-shaped portion that is provided in the location where the partial hole 526 is connected with the opening portion 527. The hook portion 528 extends toward the left such that it narrows the space in the location where the partial hole 526 is connected with the opening portion 527. Furthermore, the left end of the hook portion 528 is positioned to the left of the center of the partial hole 526 in the left-right direction. Therefore, in a case where the end portion of the upper thread 15 that has been guided into the partial hole 526 moves toward the opening portion 527, the hook portion 528 may catch the end portion of the upper thread 15. The hook portion 528 may thus restrict the end portion of the upper thread 15 such that the end portion of the upper thread 15 tends not to move into the opening portion 527.

As shown in FIG. 4, the fiber member 58 is provided on the bottom face of the second plate portion 512 of the fixed plate 51. In the fiber member 58, a plurality of soft, short, fibers 581 are attached in a closely packed manner to a ground fabric 582 that serves as a base. The fiber member 58 is affixed to the fixed plate 51 by affixing the ground fabric 582 to the bottom face of the second plate portion 512. The tips (bottom ends) of the fibers 581 may lightly touch the top face of the movable plate support member 56. As will be described in detail later, the end portion of the upper thread 15 that has been cut by the thread-cutting mechanism 102 may be pulled between the tips of the fibers 581 and the top face of the movable plate support member 56 by the operation by which the wiper 71 moves to the stand-by position. At this time, the end portion of the upper thread 15 may be held lightly by the touching of the tips of fibers 581 on the upper thread 15.

A wiper mechanism 70 will be explained with reference to FIGS. 6 and 13. The wiper mechanism 70 is provided on the front end of the arm 4. Note that in FIG. 6, the position of the wiper 71 in the left-right direction is fixed, and the holding member 50 and the like that are provided in the needle bar case 21 may move in the left-right direction.

Figure 6:
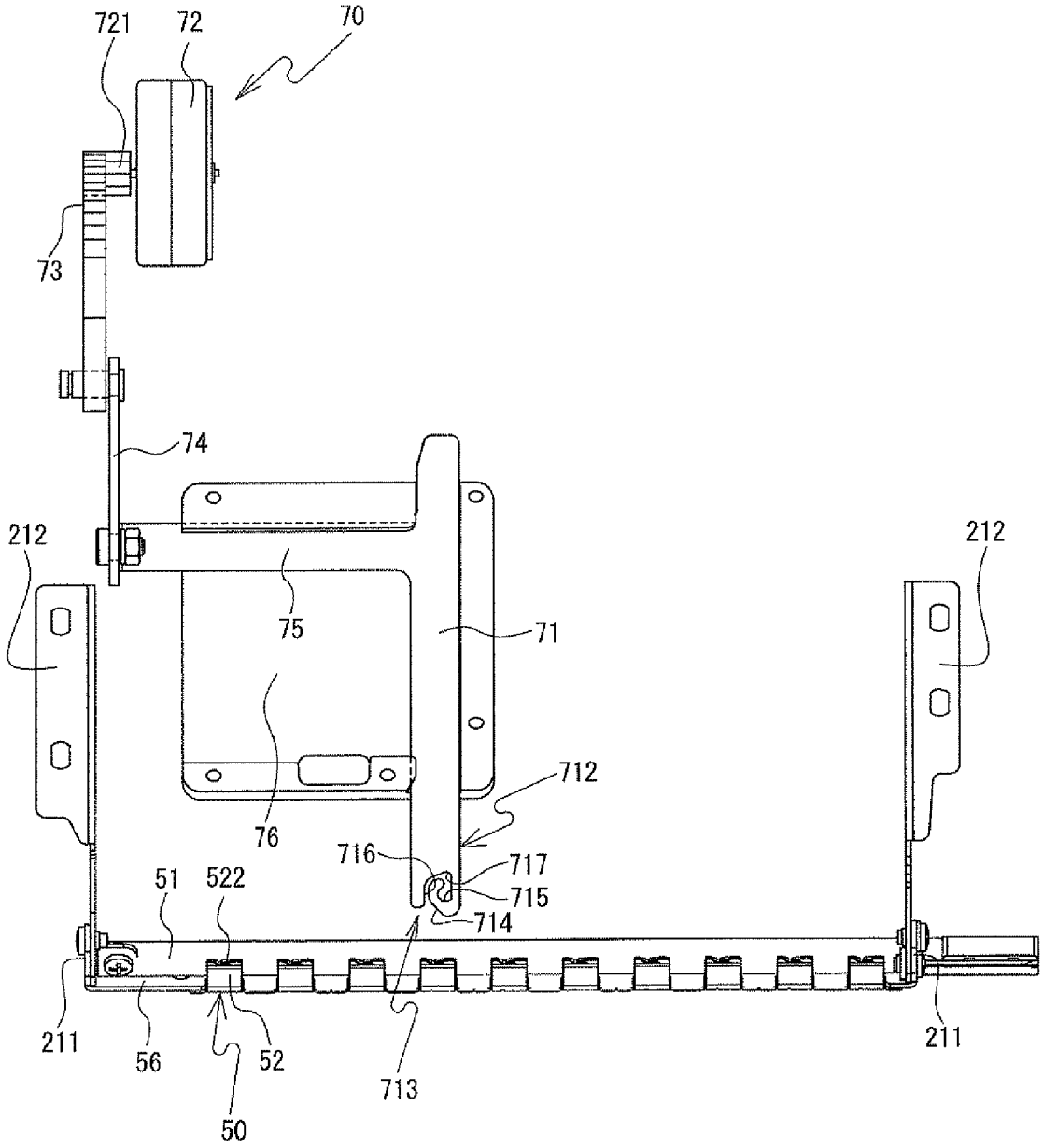
FIG. 6 is a figure that shows a positional relationship between a wiper mechanism and the holding member, as seen from the front.

As shown in FIGS. 6 and 13, the wiper mechanism 70 includes a drive motor 72, a sector gear 73, a link member 74, a wiper coupling portion 75, the wiper 71, and the like. A rotating shaft of the drive motor 72 protrudes to the left, and a gear 721 is mounted to the end of the rotating shaft. The gear 721 engages with the sector gear 73. The sector gear 73 is positioned obliquely below and in front of the gear 721. The sector gear 73 has an approximately semicircular shape and, on a portion of the arc of that semicircular shape, is provided with teeth that engage with the gear 721. A gear projecting portion 731 that projects toward the outside in the radial direction of the sector gear 73 is provided on a rear end portion of the arc of the semicircular shape of the sector gear 73 (refer to FIG. 13).

The link member 74 is coupled to an outer end portion of the gear projecting portion 731, being joined to the gear projecting portion 731 by a pin such that the link member 74 can rotate in relation to the gear projecting portion 731. The link member 74 extends obliquely downward toward the front, and its opposite end is joined to the wiper coupling portion 75 by a pin such that it can rotate in relation to the wiper coupling portion 75, which is formed as a single unit with the wiper 71. The wiper coupling portion 75 extends to the right from the point where it is joined to the link member 74 by the pin and is connected to the wiper 71. The wiper 71 extends obliquely downward toward the front. The wiper coupling portion 75 and the wiper 71 are positioned on a top side of a support plate 76. The support plate 76 supports the wiper coupling portion 75 and the wiper 71 such that they can advance and retract obliquely downward toward the front.

As shown in FIG. 6, a slotted thread hook portion 713 is provided in a tip portion 712 on the obliquely lower front end of the wiper 71. The wiper 71 can hook the upper thread 15 with the thread hook portion 713 and can guide the upper thread 15 to the holding member 50. The thread hook portion 713 includes an entrance portion 714, a thread hook hole 715, and a thread guide passage 716. The entrance portion 714 is a portion that is notched obliquely into the tip of the wiper 71, and it extends obliquely leftward and to the rear from the right side of the tip of the wiper 71. The thread guide passage 716 is a passage that extends slightly to the rear from the left edge of the entrance portion 714 and curves obliquely rightward and to the rear. The thread hook hole 715 is a partial hole that is formed in front of a rear end portion 717 of the curved thread guide passage 716.

A case in which the wiper 71 moves from the stand-by position (refer to FIG. 4) to the extended position (refer to FIG. 16) will be explained. The gear 721 may be rotated by the operation of the drive motor 72. In conjunction with the rotation of the gear 721, the sector gear 73 rotates in the counterclockwise direction in FIG. 13. In conjunction with the rotation of the sector gear 73, the gear projecting portion 731 rotates. The rotating of the gear projecting portion 731 causes the link member 74, which is coupled to the gear projecting portion 731, to move the wiper coupling portion 75 and the wiper 71, which are formed as a single unit. The wiper 71 moves obliquely downward toward the front along the support plate 76. The tip of the wiper 71 (the tip portion of the entrance portion 714) passes between the movable plate support member 56 and the second plate portion 512 of the fixed plate 51 and comes into contact with the movable plate 52. Then the wiper 71 moves the movable plate 52 from the clamping position (refer to FIG. 4) to the open position (refer to FIG. 16) and arrives at the extended position (refer to FIG. 16). In a case where the wiper 71 moves from the extended position (refer to FIG. 16) to the stand-by position (refer to FIG. 4), the drive motor 72 operates such that the gear 721 rotates in the opposite direction. Then the sector gear 73 rotates in the clockwise direction in FIG. 13, causing the wiper 71 to return to the stand-by position (refer to FIG. 18).

When the wiper 71 moves obliquely downward toward the front toward the extended position, the entrance portion 714 may come into contact with the upper thread 15 (refer to FIG. 4). Then the moving of the wiper 71 to the extended position may cause the upper thread 15 to be guided into the thread guide passage 716 along the entrance portion 714. When the wiper 71 arrives at the extended position (refer to FIG. 16), the upper thread 15 may be guided along the thread guide passage 716 and arrives at the rear end portion 717 of the thread guide passage 716. Then, when the wiper 71 moves obliquely upward toward the rear from the extended position (refer to FIG. 16) toward the stand-by position (refer to FIG. 18), the upper thread 15 may be guided into the thread hook hole 715. The upper thread 15 may be guided obliquely upward toward the rear by the moving of the wiper 71 to the stand-by position. In this manner, the wiper 71 may capture the upper thread 15 at the extended position and guide the upper thread 15 to the holding member 50 while moving to the stand-by position.

A series of operations by which the holding member 50 holds the end portion of the upper thread 15 will be explained with reference to FIGS. 4 and 14 to 18. The operations that are hereinafter explained may be performed every time the color of the upper thread 15 is switched (every time the needle bar 31 positioned above the needle drop point is changed) in a case where an embroidery pattern that is made up of a plurality of colors is sewn on the work cloth 40, for example. The changing of the needle bar 31 sewing position may be performed based on embroidery data for the embroidery pattern.

As shown in FIG. 4, when the sewing by the needle bar 31 is finished, the presser foot 37 may move upward and away from the work cloth 40. At this time, the upper thread 15 may be in a state in which it passes from the eye 351 of the sewing needle 35 of the needle bar 31, through the thread hole 372 that is provided in the lower end portion 371 of the presser foot 37, and extends to the work cloth 40. Then the wiper 71 may start to move from the stand-by position (refer to FIG. 4) toward the extended position (refer to FIG. 16).

Figure 14:
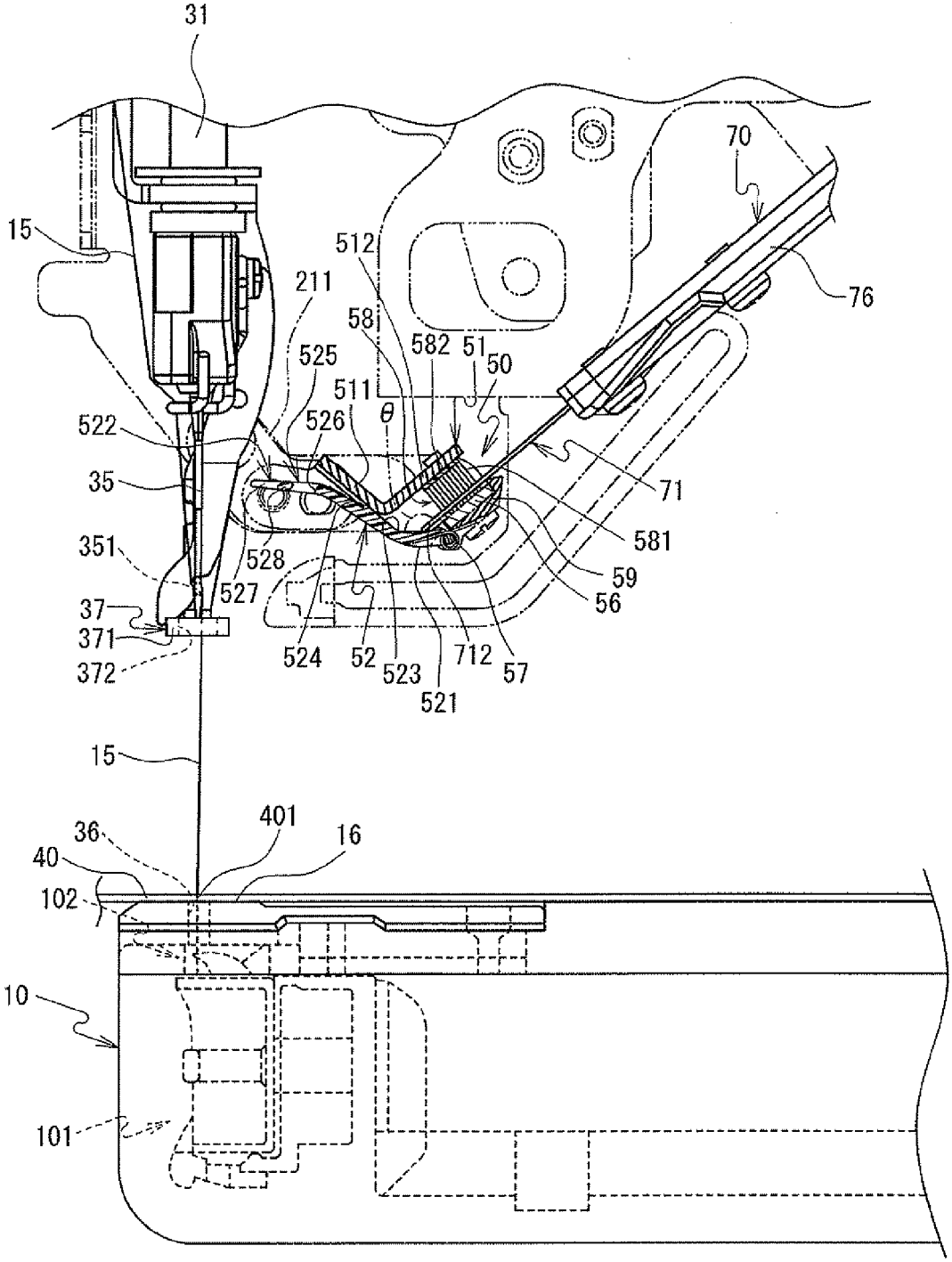
FIG. 14 is a figure that shows a state in which the wiper is in contact with the movable plate.
Figure 15:
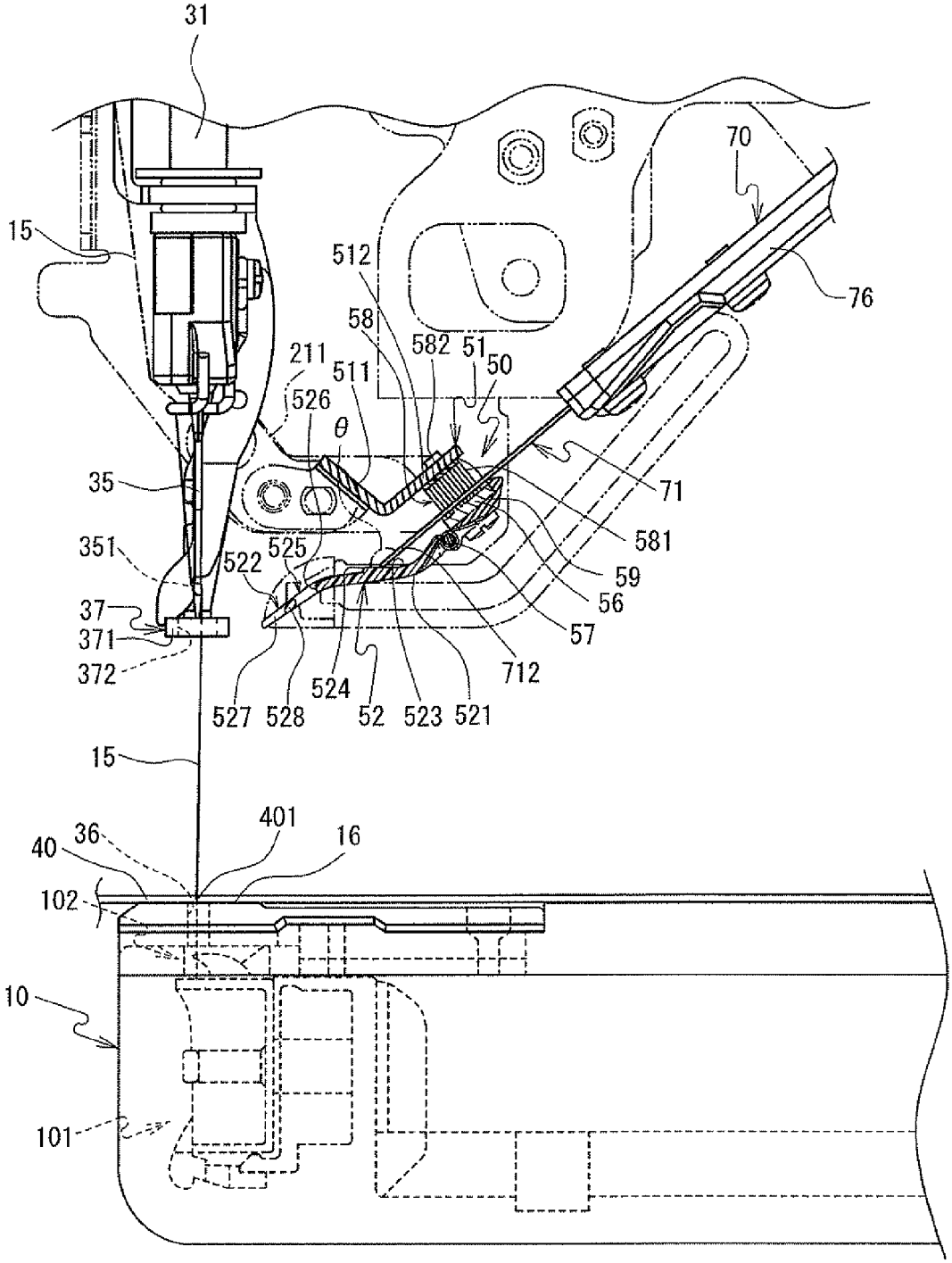
FIG. 15 is a figure that shows a state in which the wiper has rotated the movable plate.

The wiper 71 may move between the second plate portion 512 and the movable plate support member 56 while pushing through the fibers 581 of the fiber member 58. After the tip of the wiper 71 has passed between the second plate portion 512 and the movable plate support member 56, the tip of the wiper 71 may come into contact with the contact face 523 of the movable plate 52, as shown in FIG. 14. When the tip of the wiper 71 then pushes the contact face 523 of the movable plate 52 in a direction that is opposite to the direction of energizing force of the coil spring 57, the movable plate 52 may start to move from the clamping position to the open position, as shown in FIG. 15. As shown in FIG. 14, the angle θ that is formed by the contact face 523 and the travel path of the wiper 71 is an obtuse angle. The movable plate 52 therefore rotates more readily than it would in a case where the angle θ is an acute angle or a right angle. The movable plate 52 thus may move smoothly from the clamping position to the open position. Note that if the movable plate 52 rotates farther, the angle θ becomes greater (refer to FIG. 15).

Figure 16:
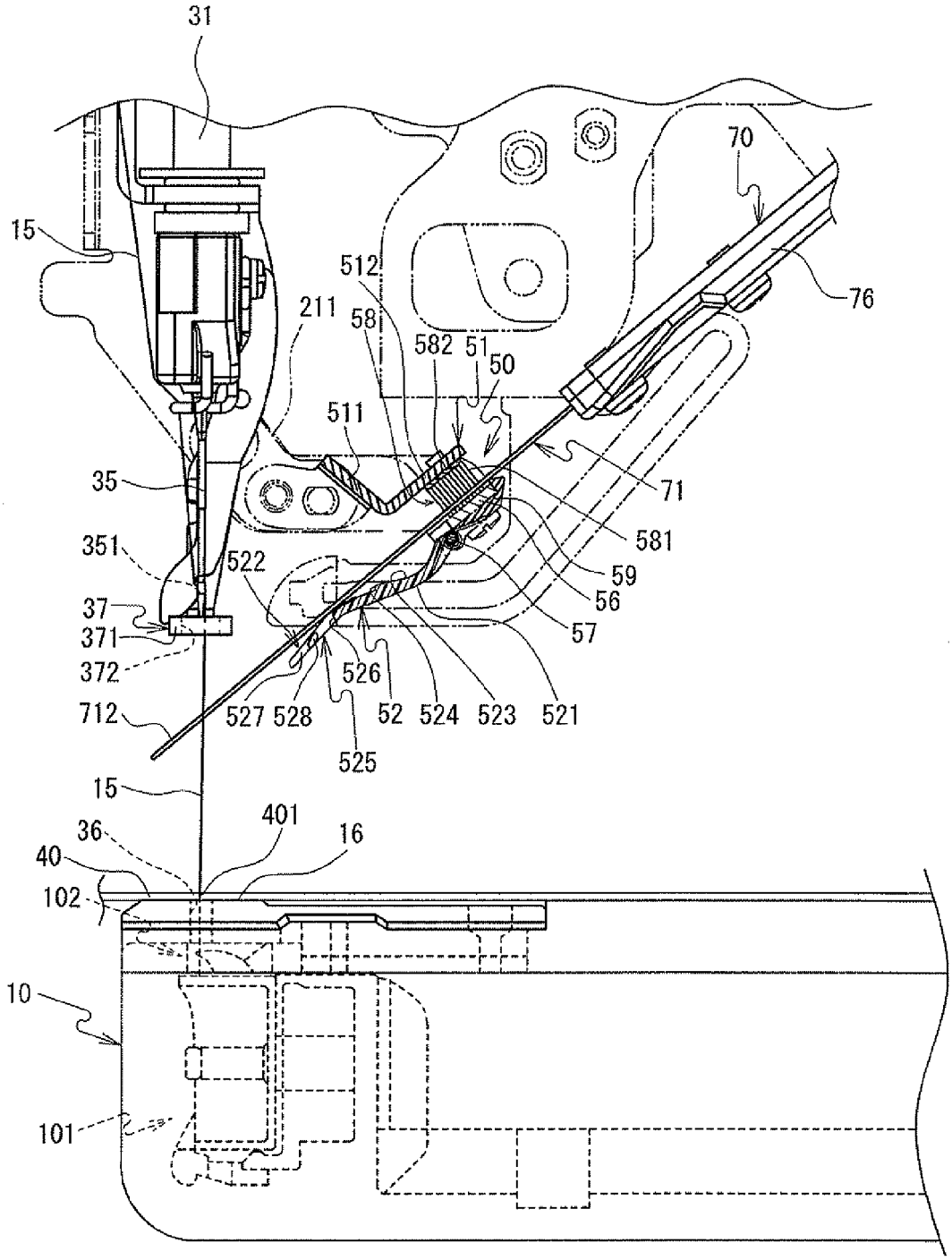
FIG. 16 is a figure that shows a state in which the wiper is in an extended position and the holding member is an open position.

When the wiper 71 moves farther toward the extended position and pushes the movable plate 52, the movable plate 52 may arrive at the open position. As shown in FIG. 16, when the movable plate 52 is in the open position, the wiper 71 can move to the extended position. When the wiper 71 is in the extended position, the thread hook portion 713 of the wiper 71 (refer to FIG. 6) may catch the upper thread 15 that extends downward from the eye 351.

Figure 17:
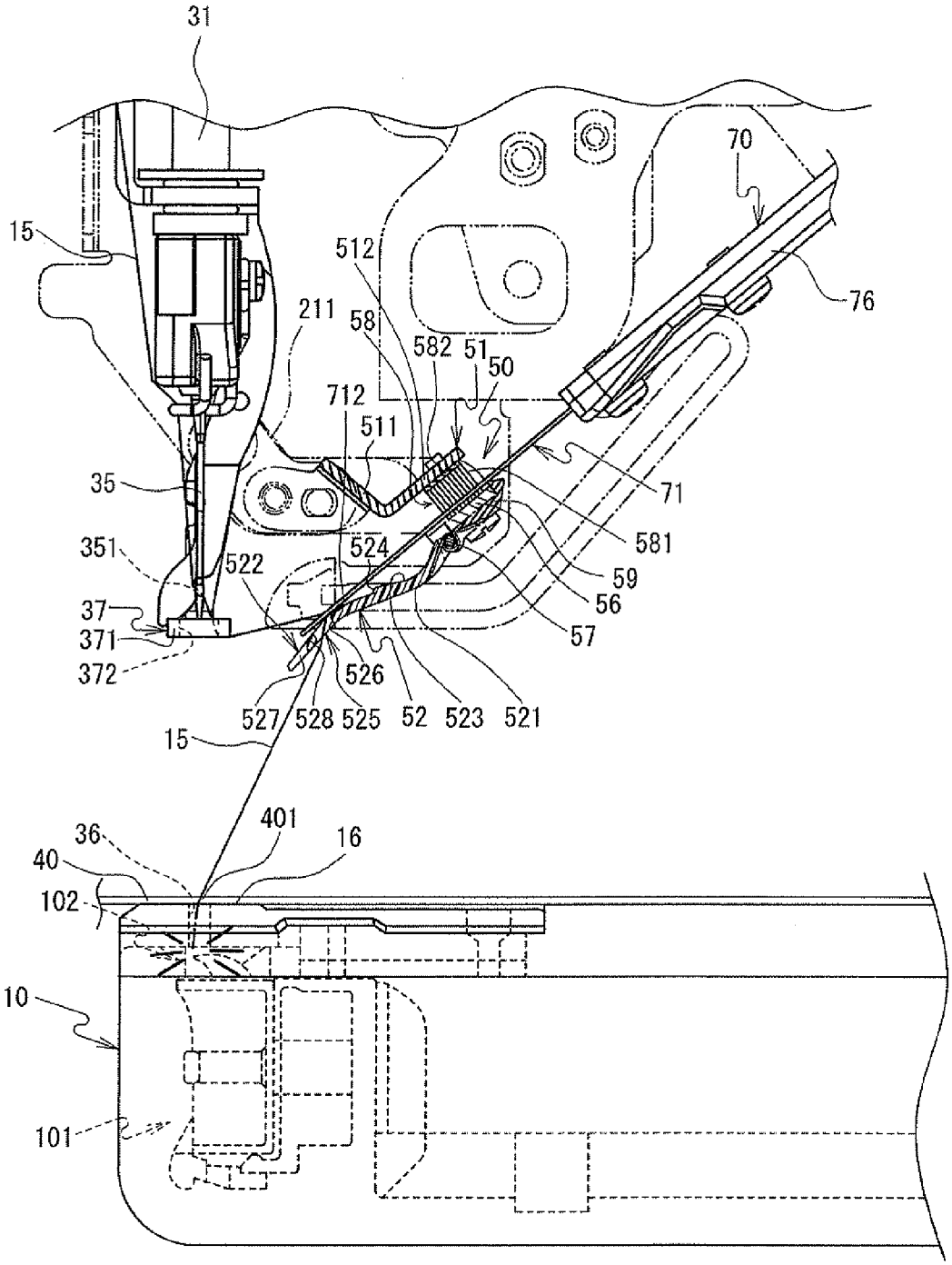
FIG. 17 is a figure that shows a state in which the upper thread has been guided into a guide portion of the movable plate.

Next, the wiper 71 may start to move from the extended position to the stand-by position. As shown in FIGS. 16 and 17, the outer end portion 522 of the movable plate 52 is curved in a direction (a downward direction) that keeps it away from the wiper 71 in the extended position. Therefore, the tip of the movable plate 52 may not touch the wiper 71. Accordingly, the tip of the movable plate 52 does not become caught on the wiper 71. Therefore, the wiper 71 may move smoothly.

When the wiper 71 starts to move to the stand-by position, the wiper 71 may guide the caught upper thread 15 toward the holding member 50, as shown in FIG. 17. The wiper 71 may also guide the caught upper thread 15 to the guide portion 525 of the movable plate 52. At this time, the upper thread 15 may be guided by the wiper 71 from the opening portion 527 of the guide portion 525 toward the partial hole 526. As shown in FIG. 5, the opening portion 527 is formed such that the opening becomes wider toward the outer end. Therefore, the end portion of the guided upper thread 15 may be reliably fed into the opening portion 527 and is guided toward the partial hole 526. Furthermore, as shown in FIG. 17, as the upper thread 15 is guided into the partial hole 526, the upper thread 15 may be cut by the thread-cutting mechanism 102.

Figure 18:
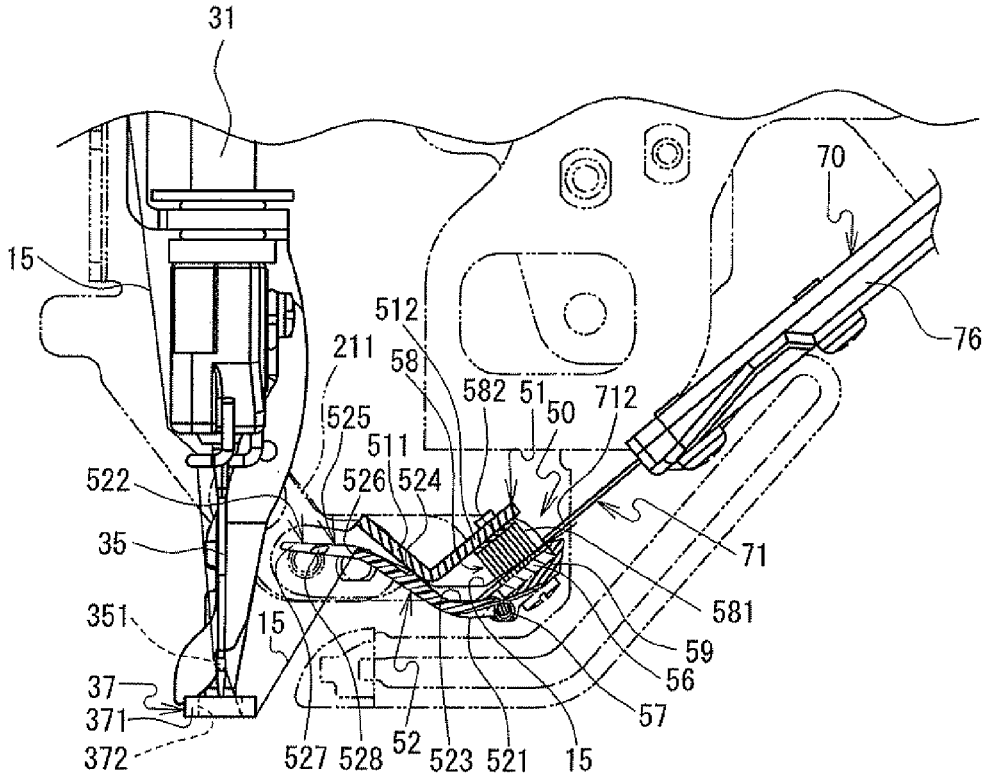
FIG. 18 is a figure that shows a state in which, after the upper thread is clamped, the wiper is in the stand-by position, and the movable plate is in the clamping position.
Figure 18:
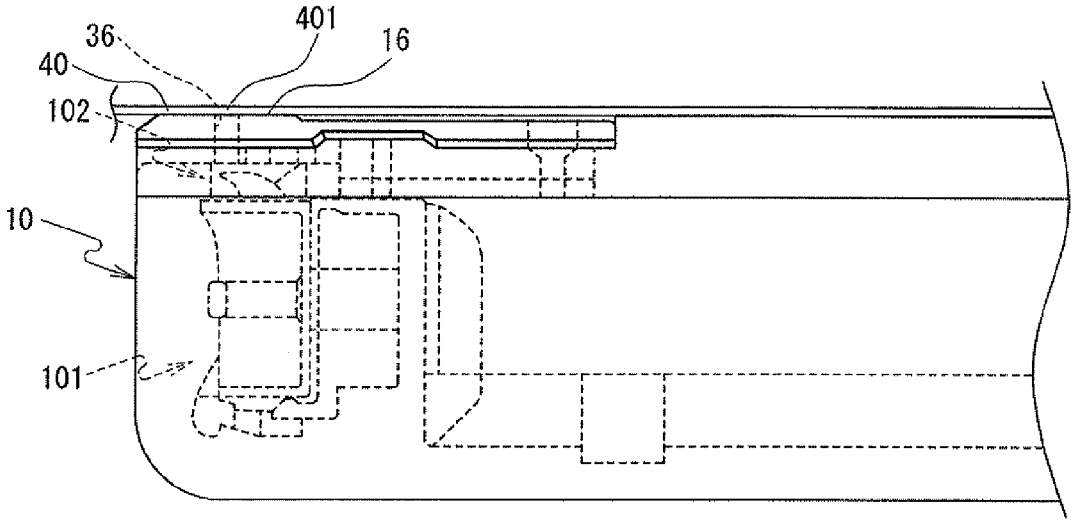

When the wiper 71 moves farther toward the stand-by position from the state that is shown in FIG. 17, the end portion of the upper thread 15 may be guided between the fixed plate 51 and the raised portion 524 of the movable plate 52. In addition, the movable plate 52 may start to be rotated from the open position to the clamping position by the elastic force of the coil spring 57. Then, when the wiper 71 moves away from the movable plate 52, the movable plate 52 may move to the clamping position. As shown in FIG. 18, the end portion of the upper thread 15 may be clamped between the fixed plate 51 and the raised portion 524 of the movable plate 52. The end portion of the upper thread 15 may be also held by a light force between the tips of fibers 581 and the top face of the movable plate support member 56. After the end portion of the upper thread 15 has been clamped, the needle bar case 21 may move in the left-right direction, and the needle bar 31 that will be used for sewing the next color is moved to the sewing position.

Note that even if the end portion of the upper thread 15 is clamped by the holding member 50, the end portion of the upper thread 15 may be pulled by the operating and downward movement of the needle bar 31 that uses the upper thread 15, such that the end portion of the upper thread 15 may be pulled out from the holding member 50.

As described above, the operating of the multi-needle sewing machine 1 according to the present embodiment may cause the end portion of the upper thread 15 to be clamped by the holding member 50. As shown in FIG. 18, the end portion of the upper thread 15 that has been clamped by the holding member 50 may be guided by the guide portion 525 such that the end portion of the upper thread 15 cannot move in the left-right direction. Therefore, even in a case where the needle bar case 21 has moved in the left-right direction, horizontal movement of the end portion of the upper thread 15 can be prevented.

Furthermore, when the wiper 71 is in the extended position and the movable plate 52 is in the open position, as shown in FIG. 16, the guide portion 525 may be positioned lower than the travel path of the wiper 71. In contrast, when the wiper 71 is in the stand-by position and the movable plate 52 is in the clamping position, as shown in FIG. 18, the guide portion 525 may be positioned higher than the travel path of the wiper 71 and obliquely above and to the rear of the thread hole 372 of the presser foot 37. Because the guide portion 525 is positioned obliquely above the presser foot 37, the end portion of the upper thread 15 that extends downward from the eye 351 of the sewing needle 35, after passing through the thread hole 372 of the presser foot 37, may be pulled up and extended obliquely upward, where it is guided by the guide portion 525 and is clamped by the movable plate 52 and the fixed plate 51 (refer to FIG. 18). The end portion of the upper thread 15 is thus held in a state in which it has been pulled such that it doubles back from the thread hole 372 of the presser foot 37. The end portion of the upper thread 15 may therefore be less likely to move at the lower end portion 371 of the presser foot 37, and horizontal movement of the end portion of the upper thread 15 can be prevented.

A virtual straight line that connects the guide portion 525 and the lower end portion 371 of the presser foot 37 is defined as a first virtual straight line. A virtual straight line that connects the raised portion 524 and the guide portion 525 is defined as a second virtual straight line. When the movable plate 52 is in the clamping position, as shown in FIG. 18, the first virtual straight line and the second virtual straight line intersect. Therefore, the end portion of the upper thread 15 that extends obliquely upward toward the rear from the bottom end of the presser foot 37 changes direction at the guide portion 525 and extends obliquely downward toward the rear. That is, the end portion of the upper thread 15 is held in a state in which it changes direction at the guide portion 525. Accordingly, the end portion of the upper thread 15 may be less likely to move at the guide portion 525, and horizontal movement of the end portion of the upper thread 15 can be prevented.

As shown in FIG. 5, the hook portion 528 is provided at the location where the partial hole 526 and the opening portion 527 of the guide portion 525, which guides the end portion of the upper thread 15, are connected with each other. Even in a case where the end portion of the upper thread 15 that is guided to the partial hole 526 tends to move toward the outer end of the movable plate 52, the end portion of the upper thread 15 may be inhibited from moving to the opening portion 527 side, because the end portion of the upper thread 15 may be caught by the hook portion 528. The end portion of the upper thread 15 can thus be inhibited from moving to the outer side of the opening portion 527.

As shown in FIG. 18, the coil spring 57 is provided below the travel path of the wiper 71 and configured to energize the movable plate 52 such that the outer end portion 522 of the movable plate 52 rotates upward. Furthermore, the upper thread 15 that is supplied from the thread spool 13 (refer to FIG. 1), after extending downward to the presser foot 37, doubles back at the lower end portion 371 of the presser foot 37 and extends toward the guide portion 525. In this case, the end portion of the upper thread 15 is held in a state in which it has been pulled such that it doubles back from the thread hole 372 of the presser foot 37. The angle at which the upper thread 15 doubles back is smaller when the guide portion 525 is higher than the presser foot 37 than it is when the guide portion 525 is lower than the presser foot 37. Therefore, the end portion of the upper thread 15 may be less likely to move at the lower end portion 371 of the presser foot 37, and horizontal movement of the end portion of the upper thread 15 can be prevented.

The movable plate 52 may be rotated by the pressing force of the wiper 71 that has come into contact with the movable plate 52 and by the energizing force of the coil spring 57. Therefore, it is not necessary to provide a separate actuator or the like for rotating the movable plate 52. As result of this, the structure of the holding member 50 may be simplified and the manufacturing cost may be reduced.

Note that the present disclosure is not limited to the embodiment that has been described above, and various types of modifications can be made. In the embodiment that is described above, when the upper thread 15 that has been clamped by the holding member 50 is used again, the end portion of the upper thread 15 is pulled out from the holding member 50 by the operating of the needle bar 31, and the sewing is performed. However, the present disclosure is not limited to this procedure. For example, in addition to the operating of the needle bar 31, the wiper 71 may be used to make it easier to draw the end portion of the upper thread 15 out of the holding member 50. Specifically, the multi-needle sewing machine 1 may bring the tip of the wiper 71 into contact with the movable plate 52 in synchronization with the timing at which the needle bar 31 moves downward, thus moving the movable plate 52 slightly away from the fixed plate 51. The force that clamps the end portion of the upper thread 15 between the movable plate 52 and the fixed plate 51 is thus weakened, making it easier to draw the end portion of the upper thread 15 out of the holding member 50.

Further, the state in which the end portion of the upper thread 15 is held has been explained using as an example a case in which the needle bar 31 positioned above the needle drop point is changed. However, the present disclosure is not limited to this example. During preparatory work before the sewing starts, for example, the wiper 71 may be operated and the end portion of the upper thread 15 may be held by the holding member 50 after the upper thread 15 has been passed through the eye 351 of the sewing needle 35. In this case, the upper thread 15 may extend toward the holding member 50 from the eye 351 of the sewing needle 35. In this case, too, horizontal movement of the end portion of the upper thread 15 can be prevented in the same manner as in the case where the upper thread 15 extends toward the holding member 50 from the lower end portion 371 of the presser foot 37.

Another point is that the upper thread 15 is cut by the thread-cutting mechanism 102 while it is being guided to the guide portion 525 by the wiper 71, as shown in FIG. 17. However, the timing at which the upper thread 15 is cut is not limited to this example. The thread-cutting mechanism 102 may also cut the upper thread 15 before the wiper 71 starts to move from the stand-by position to the extended position, for example.

Still another point is that the raised portion 524 is provided on the movable plate 52, and the end portion of the upper thread 15 is clamped between the raised portion 524 and the fixed plate 51. However, the present disclosure is not limited to this example. A raised portion may also be provided on the fixed plate 51, for example. The end portion of the upper thread 15 may also be clamped between the movable plate 52 and the fixed plate 51 without any raised portion being provided.

Figure 19:
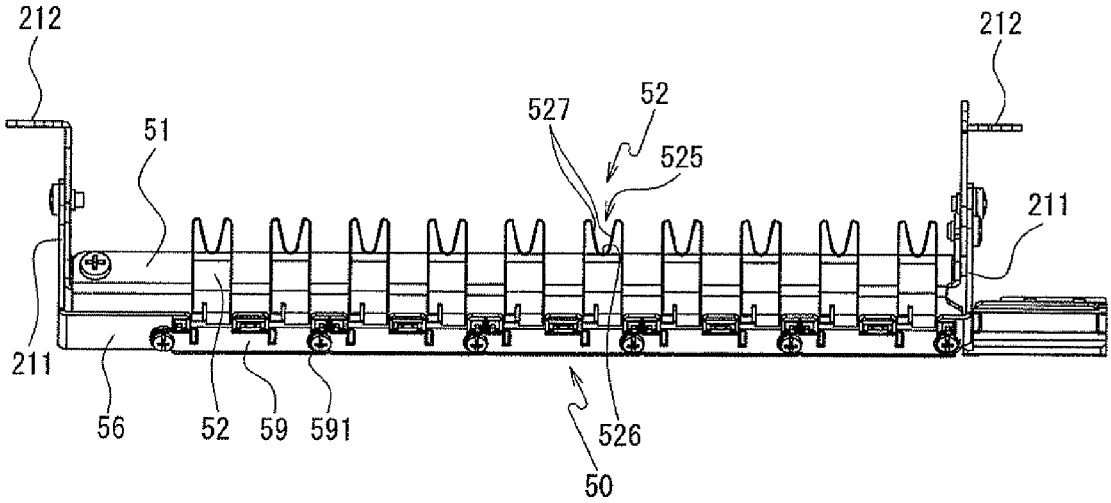
FIG. 19 is a bottom view of the holding member that shows a modified example of the guide portion.

The hook portion 528 is provided in the guide portion 525 of the movable plate 52. However, the present disclosure is not limited to this configuration. For example, the guide portion 525 may also be formed from the partial hole 526 and the opening portion 527, without the hook portion 528 being provided, as in the modified example that is shown in FIG. 19. In this case, the guide portion 525 is formed by notching the movable plate 52 in a shape in which the opening portion 527 becomes wider from that partial hole 526 toward the outer end. In this case as well, the guide portion 525 can restrict the movement of the end portion of the upper thread 15 with the partial hole 526 and the opening portion 527. Therefore, the end portion of the upper thread 15 that has been guided into the partial hole 526 is held such that it cannot move in the left-right direction, and horizontal movement of the end portion of the upper thread 15 when the needle bar case 21 moves can be prevented.

In the embodiment that is described above, the guide portion 525 includes the partial hole 526 and the opening portion 527. However, the guide portion 525 is not required to have a configuration in which it is provided with the partial hole 526 and the opening portion 527. In that case, the guide portion 525 may be formed as a rectangular shape, a semicircular shape, or a triangular shape that is cut out of the outer end of the movable plate 52. In this case, too, the guide portion 525 can restrict the movement of the end portion of the upper thread 15 in the left-right direction, such that horizontal movement of the end portion of the upper thread 15 can be prevented.

In the embodiment that is described above, the partial hole 526 is a portion of a circular through-hole. However, the shape of the partial hole 526 is not limited to being circular. For example, the partial hole 526 may also be a portion of a through-hole that is one of rectangular and triangular. In this case as well, the guide portion 525 can restrict the movement of the end portion of the upper thread 15 in the left-right direction, such that horizontal movement of the end portion of the upper thread 15 can be prevented.

Various types of modifications can also be made in the shape of the hook portion 528 that is provided in the guide portion 525 of the movable plate 52. For example, the hook portion 528 may also be provided on the left side, and on both the left and right sides.

In the embodiment that is described above, the thread hook portion 713 of the wiper 71 includes the entrance portion 714, the thread hook hole 715, and the thread guide passage 716. However, the thread hook portion 713 is not required to have a configuration in which it is provided with the entrance portion 714, the thread hook hole 715, and the thread guide passage 716. In that case, the thread hook portion 713 may have any shaped, such as an L-shaped or a V-shaped hook portion, as far as the thread hook portion 713 can catch and guide the upper thread 15.

In the embodiment that is described above, the number of the needle bars 31 which is supported by the needle bar case 21 is ten. However, the number of the needle bars 31 is not limited to ten. The number of the needle bars 31 can be changed based on a type of the multi-needle sewing machine or like that. In the embodiment, the holding member 50 includes the fiber member 58. However, the holding member may not be provided with the fiber member 58.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A multi-needle sewing machine, comprising:

needle bars that are arranged and on the lower end of each of which a sewing needle can be mounted;

presser feet, each of which is provided below one of the needle bars and configured to move up and down between a lower position and an upper position, the lower position being a position that the presser foot can contact a work cloth, the upper position being a position that is higher than the lower position;

a support member configured to support the needle bars such that the needle bars can move up and down, and configured to move one of the needle bars to a position directly above a needle drop point by moving along an array direction in which the needle bars are arrayed, the needle drop point being a sewing position on the work cloth;

a cutting member that is provided below the needle drop point and configured to cut an upper thread inserted through and extending downward from an eye of the sewing needle that is mounted to one of the needle bars positioned directly above the needle drop point;

a guide member configured to move between an extended position and a stand-by position, configured to catch the upper thread at the extended position, and configured to guide the upper thread by moving from the extended position to the stand-by position, the extended position being a position to which the guide member is extended and that is located between the needle drop point and one of the presser feet provided below the one of the needle bars positioned directly above the needle drop point, the one of the presser feet being in the upper position, and the stand-by position being a position in which the guide member is separated from a gap between the needle drop point and the one of the presser feet that is in the upper position; and a holding member configured to hold an end portion of the upper thread that has been guided by the guide member and has been cut by the cutting member, the holding member including:

a fixed member that is mounted to the support member;

movable members each of which is provided for one of the needle bars, configured to move in relation to the fixed member and to rotate between an open position and a clamping position, and includes a guide portion formed by cutting a notch in an outer end portion on the needle bar side of the movable member, the open position being a position in which the movable member is separated from the fixed member, such that the guide member can move to the extended position, the clamping position being a position in which the movable member is positioned on a travel path of the guide member and is in contact with the fixed member, and the travel path being a path between the extended position and the stand-by position of the guide member; and elastic members each of which is provided for each one of the movable members and is configured to elastically energize the each one of the movable members toward the fixed member, such that the each one of the movable members is to be positioned in the clamping position, wherein:

the guide member, when the guide member moves from the stand-by position to the extended position, moves one of the movable members from the clamping position to the open position in opposition to an elastic force of corresponding one of the elastic members, and the guide member, when the guide member moves from the extended position to the stand-by position, guides the upper thread to the guide portion of the corresponding one of the movable members, and the end portion of the upper thread is clamped between the fixed member and the corresponding one of the movable members, which has been moved to the clamping position by the elastic force of the corresponding one of the elastic members.

2. The multi-needle sewing machine according to claim 1, wherein each one of the presser feet includes at a lower end thereof a thread hole that extends in an up-down direction through which the sewing needle and the upper thread can pass up and down, the guide portion is positioned lower than the travel path of the guide member when the guide member is in the extended position and the movable member is in the open position, and the guide portion is positioned higher than the travel path of the guide member and obliquely above the thread hole of the presser foot when the guide member is in the stand-by position and the movable member is in the clamping position.

3. The multi-needle sewing machine according to claim 1, wherein each of the movable members includes a raised portion that protrudes toward the fixed member between a base end portion and the guide portion, the raised portion configured to contact the fixed member when the movable member is in the clamping position, such that the end portion of the upper thread that has been guided to the guide portion by the guide member is clamped between the raised portion and the fixed member.

4. The multi-needle sewing machine according to claim 1, wherein the guide portion includes, an opening portion that is formed as an opening in the outer end portion of the movable member, the opening becoming larger toward an outer end, and a partial hole that is continuous with the opening portion.

5. A multi-needle sewing machine according to claim 4, wherein each of the movable members includes a hook portion in a location where the opening portion connects with the partial hole.

6. The multi-needle sewing machine according to claim 1, wherein each of the movable members includes a contact face configured to contact a tip of the guide member when the guide member moves from the stand-by position to the extended position, the contact face being inclined in relation to the travel path of the guide member such that a contact angle is an obtuse angle, the contact angle being an angle that, of the angles that are formed by the contact face and the travel path of the guide member, is on the outer end portion side of the movable member.

7. The multi-needle sewing machine according to claim 1, wherein the outer end portion of the movable member is curved in a direction away from the guide member in the extended position.

8. The multi-needle sewing machine according to claim 1, wherein each of the elastic members is provided below the travel path of the guide member and configured to energize corresponding one of the movable members such that the outer end portion of the movable member rotates upward.

* * * * *